US011097556B2

(12) United States Patent
Hoshino et al.

(10) Patent No.: US 11,097,556 B2
(45) Date of Patent: Aug. 24, 2021

(54) DRYING DEVICE AND PRINTER INCORPORATING THE DRYING DEVICE

(71) Applicants: Yoshiaki Hoshino, Kanagawa (JP); Osamu Takehira, Kanagawa (JP); Hirokazu Ikenoue, Tokyo (JP); Satoshi Kitaoka, Kanagawa (JP)

(72) Inventors: Yoshiaki Hoshino, Kanagawa (JP); Osamu Takehira, Kanagawa (JP); Hirokazu Ikenoue, Tokyo (JP); Satoshi Kitaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 94 days.

(21) Appl. No.: 16/514,572

(22) Filed: Jul. 17, 2019

(65) Prior Publication Data

US 2020/0023654 A1 Jan. 23, 2020

(30) Foreign Application Priority Data

Jul. 23, 2018 (JP) ..... JP2018-137922

(51) Int. Cl.
*F26B 3/32* (2006.01)
*B41J 11/00* (2006.01)
*F26B 13/18* (2006.01)

(52) U.S. Cl.
CPC ..... *B41J 11/002* (2013.01); *F26B 13/18* (2013.01)

(58) Field of Classification Search
CPC ..... B41J 11/057; B41J 11/002; F26B 13/14; F26B 13/18; F26B 13/145; F26B 13/08; F26B 13/002
USPC ..... 34/520, 519, 345, 343, 113, 95
See application file for complete search history.

(56) References Cited

U.S. PATENT DOCUMENTS 3,595,539 A * 7/1971 Kimura ..... B05D 3/0254 432/228
2008/0308001 A1* 12/2008 Okada ..... C09D 11/52 106/1.19
2009/0160896 A1* 6/2009 Yamagata ..... B41J 2/0458 347/14
2015/0291819 A1* 10/2015 Mizutani ..... C09D 11/107 428/207
2016/0101635 A1 4/2016 Hoshino et al.
2016/0263914 A1 9/2016 Hoshino
2016/0313059 A1 10/2016 Boland et al.
2017/0173972 A1* 6/2017 Ohshima ..... B41M 5/0011
(Continued)

FOREIGN PATENT DOCUMENTS

JP 2000-211116 8/2000
JP 2004-142166 5/2004
(Continued)

*Primary Examiner* — John P McCormack
(74) *Attorney, Agent, or Firm* — Duft & Bornsen, PC

(57) ABSTRACT

A drying device includes a plurality of guide rollers and a heater. The plurality of guide rollers is configured to contact a liquid applied face of a drying target object that is conveyed with liquid applied to the liquid applied face, while the drying target object is dried. The plurality of guide rollers includes at least one guide roller having a surface roughness of from 2 to 8. The heater is configured to heat the drying target object while the plurality of guide rollers guides the drying target object. A printer includes a liquid application device configured to apply liquid to a drying target object, and the drying device.

15 Claims, 4 Drawing Sheets

(56) References Cited

U.S. PATENT DOCUMENTS

| | | | | |
|---|---|---|---|---|
| 2017/0266991 | A1 | 9/2017 | Onodera et al. | |
| 2017/0334217 | A1 | 11/2017 | Yoshinuma et al. | |
| 2018/0066149 | A1* | 3/2018 | Nishiyama | C09D 11/34 |

FOREIGN PATENT DOCUMENTS

| | | |
|---|---|---|
| JP | 2010-208099 | 9/2010 |
| JP | 2015-016669 | 1/2015 |
| JP | 2016-078428 | 5/2016 |
| JP | 2016-107519 | 6/2016 |
| JP | 2016-168695 | 9/2016 |
| JP | 2017-094515 | 6/2017 |

* cited by examiner

| GUIDE ROLLER SURFACE ROUGHNESS Ra | VOID RATIO |
|---|---|
| 1 | 0.1 |
| 1.5 | 0.035 |
| 2 | 0.03 |
| 3.5 | 0.002 |
| 5 | 0.002 |
| 6.5 | 0.005 |
| 8 | 0.03 |
| 10 | 0.08 |
| 13 | 0.15 |

DRYING DEVICE AND PRINTER INCORPORATING THE DRYING DEVICE

CROSS-REFERENCE TO RELATED APPLICATION

This patent application is based on and claims priority pursuant to 35 U.S.C. § 119(a) to Japanese Patent Application No. 2018-137922, filed on Jul. 23, 2018, in the Japan Patent Office, the entire disclosure of which is hereby incorporated by reference herein.

BACKGROUND

Technical Field

This disclosure relates to a drying device and a printer incorporating the drying device.

Related Art

Printers that apply liquid onto a continuous sheet to form images on the continuous sheet include a heating unit to dry the images after application of liquid to the continuous sheet.

For example, a known drying device blows warm air toward a printing face of a web-shaped sheet while a non-printing face of the web-shaped sheet is being wound around and in contact with multiple heat rollers, change the direction of conveyance of the web-shaped sheet in the known drying device, and causes the multiple heat rollers to contact the non-printing face of the web-shaped sheet again while a guide roller or guide rollers contact with the printing face of the web-shaped sheet. By so doing, the known drying device dries the continuous sheet such as the web-shaped sheet.

SUMMARY

At least one aspect of this disclosure provides a drying device including a plurality of guide rollers and a heater. The plurality of guide rollers is configured to contact a liquid applied face of a drying target object that is conveyed with liquid applied to the liquid applied face, while the drying target object is dried. The plurality of guide rollers includes at least one guide roller having a surface roughness of from 2 to 8. The heater is configured to heat the drying target object while the plurality of guide rollers guides the drying target object.

Further, at least one aspect of this disclosure provides a printer including a liquid application device configured to apply liquid to a drying target object, and the above-described drying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
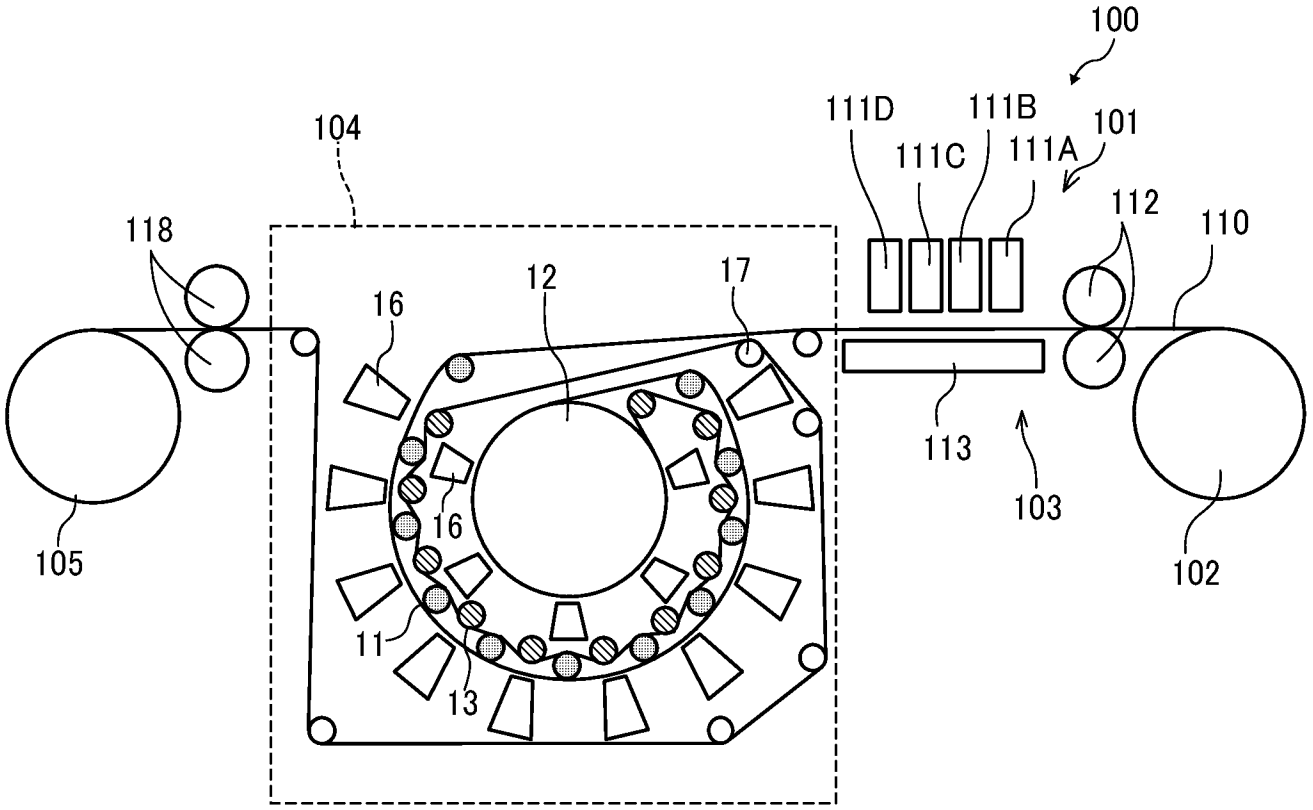
FIG. 1 is a schematic diagram illustrating a printer according to Embodiment 1 of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any drying device, and is implemented in the most effective manner in any inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a drying device and a printer incorporating the drying device, with reference to the following figures.

It is to be noted that elements (for example, mechanical parts and components) having the same functions and shapes are denoted by the same reference numerals throughout the specification and redundant descriptions are omitted.

First, a description is given of a printer 100 according to Embodiment 1, with reference to FIG. 1.

FIG. 1 is a schematic diagram illustrating the printer 100 according to Embodiment 1 of this disclosure.

It is to be noted in the following examples that: the term "printer" indicates an apparatus in which an image is printed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the printer 100 is an inkjet recording apparatus and includes a liquid application device 101 including liquid discharge heads 111 as a liquid applicator to discharge and apply an ink which is liquid of a given color to a continuous sheet 110 that functions as an object to be conveyed, in other words, as a drying target object.

For example, the liquid application device 101 has full line type liquid discharge heads 111 (i.e., full line type liquid discharge heads 111A, 111B, 111C, and 111D) for four colors aligned from an upstream side of a sheet conveying direction of the continuous sheet 110. The full line type liquid discharge heads 111A, 111B, 111C, and 111D apply liquids of black (K), cyan (C), magenta (M), and yellow (Y) to the continuous sheet 110, respectively. The types of colors and the number of colors are not limited to the above-described configuration.

The continuous sheet 110 is fed out from a feed roller 102 and is conveyed by a pair of sheet conveying rollers 112 of a conveying unit 103, onto a sheet conveyance guide 113 that is disposed facing the liquid application device 101. Then, the continuous sheet 110 is guided by the sheet conveyance guide 113 to be further conveyed (moved).

The continuous sheet 110 to which liquid has been applied by the liquid application device 101 passes through a drying device 104 according to an embodiment of the present embodiment. Then, the continuous sheet 110 is further conveyed by a pair of sheet ejecting rollers 118 to be taken up by a take-up roller 105.

Figure 2:
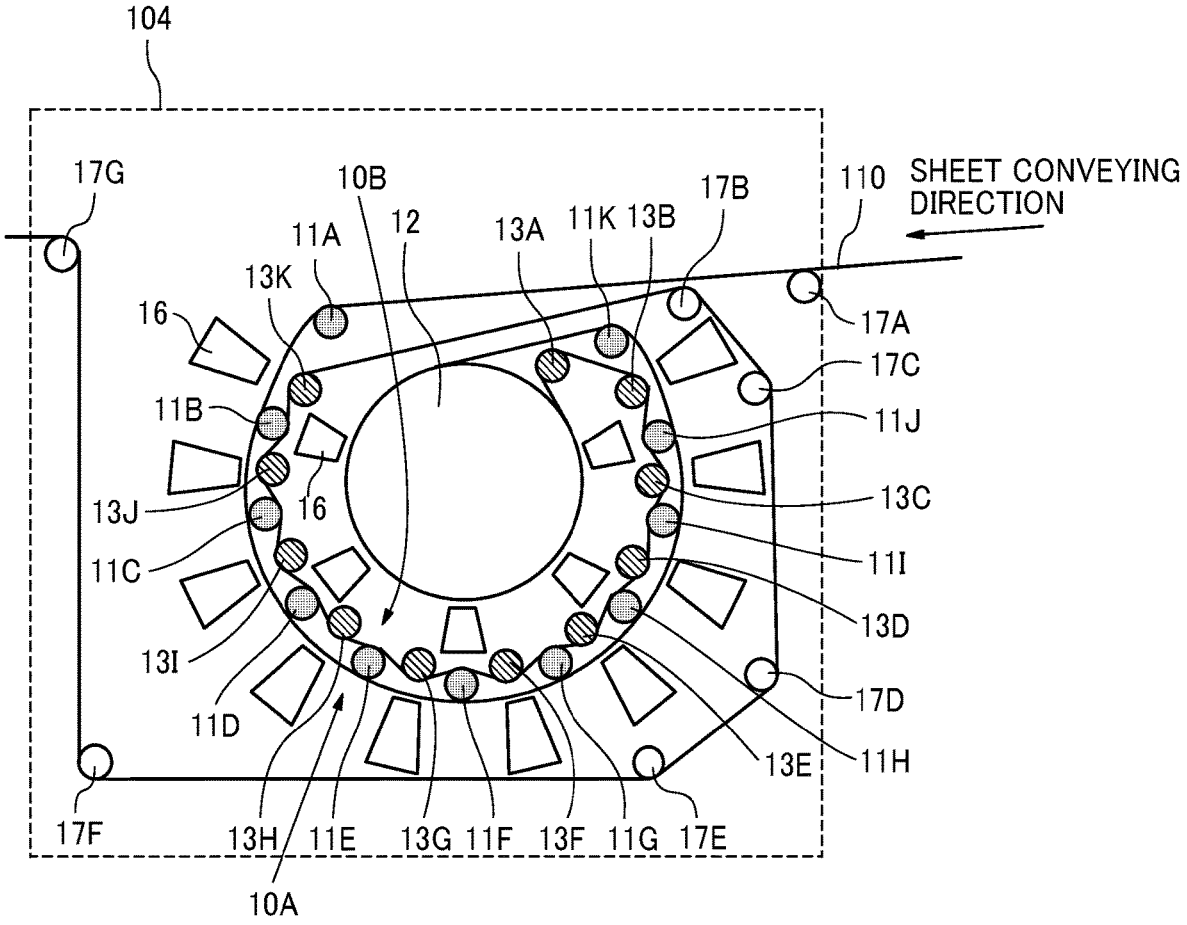
FIG. 2 is an enlarged view illustrating a drying device according to Embodiment 1.

Next, a description is given of the drying device 104 according to Embodiment 1 of this disclosure, with reference to FIG. 2.

FIG. 2 is an enlarged view illustrating the drying device 104 according to Embodiment 1.

The drying device 104 includes multiple heat rollers 11 (i.e., heat rollers 11A to 11J) and a heat drum 12. The multiple heat rollers 11A to 11J function as multiple contact type heaters, each having a curve-shaped contact face to heat the continuous sheet 110 by contacting the continuous sheet 110. The heat drum 12 functions as a contact type heater having a curve-shaped contact face.

The drying device 104 further includes guide rollers 13A to 13K. Specifically, the guide roller 13A is disposed downstream from the heat drum 12 in the sheet conveying direction and functions as a contact guide to guide the continuous sheet 110 to the heat roller 11J. The guide rollers 13B to 13K function as contact guides to guide the continuous sheet 110, which has been guided by the guide roller 13A, to contact the heat rollers 11I to 11B.

Here, the multiple heat rollers 11A to 11K are disposed in a substantially arc shape around the heat drum 12. It is to be noted that the diameters of the multiple heat rollers 11A to 11K may be identical to each other or different from each other. Further, each of the guide rollers 13B to 13K is disposed between two adjacent heat rollers 11.

The multiple heat rollers 11 (i.e., the heat rollers 11A to 11K), the heat drum 12, and the multiple guide rollers 13 (i.e., the guide rollers 13A to 13K) form a sheet heating and conveying passage (conveyance passage) to heat the continuous sheet 110. The continuous sheet 110 is conveyed while contacting an outer circumference of the multiple heat rollers 11 disposed upstream from the heat drum 12 in the sheet conveying direction, in a substantially arc shape. After passing the heat drum 12, the continuous sheet 110 is guided by the multiple guide rollers 13 to be conveyed while contacting an inner circumference of the multiple heat rollers 11 again.

Further, the drying device 104 includes a series of multiple warm air blowing fans 16. Each of the multiple warm air blowing fans 16 functions as a non-contact type heater. The series of multiple warm air blowing fans 16 are disposed along an outer circumference of arrangement of the multiple heat rollers 11 to heat the continuous sheet 110 from the liquid applied face of the continuous sheet 110. In addition, another series of multiple warm air blowing fans 16 are disposed along an outer circumference of the heat drum 12.

The drying device 104 further includes multiple guide rollers 17, which are guide rollers 17A to 17G. The guide roller 17A guides loading of the continuous sheet 110 into the drying device 104. The multiple guide rollers 17B to 17G guides ejection of the continuous sheet 110 from the drying device 104 after the continuous sheet 110 passes the guide roller 13K.

As a flow of drying the continuous sheet 110 in the drying device 104 having the above-described configuration, the liquid applied face of the continuous sheet 110 is heated while the liquid applied face of the continuous sheet 110 and an opposite face that is opposite the liquid applied face of the continuous sheet 110 are in contact with the heat rollers 11. At the same time, the warm air blowing fans 16 blow warm air toward the liquid applied face of the continuous sheet 110 to heat the liquid applied face.

Next, the continuous sheet 110 is heated while the opposite face of the continuous sheet 110, which is opposite the liquid applied face of the continuous sheet 110, are conveyed in contact with the outer circumference of the heat drum 12 disposed inside the substantially arc shape of the continuous sheet 110. At the same time, the warm air blowing fans 16 blow warm air to the liquid applied face of the continuous sheet 110 to heat the liquid applied face of the continuous sheet 110.

Thereafter, while causing the guide rollers 13 to contact the liquid applied face of the continuous sheet 110, the heat rollers 11 contact the opposite face of the continuous sheet 110 to heat the continuous sheet 110 again. According to this configuration, the liquid applied to the continuous sheet 110 is dried.

Specifically, in the present embodiment, the multiple heat rollers 11 (i.e., the heat rollers 11A to 11K), to which the continuous sheet 110 contacts for a first path of conveyance of the continuous sheet 110, define a first heating unit 10A that dries a drying target object (i.e., the continuous sheet 110) to a first dry state.

In addition, the multiple heat rollers 11 (i.e., the heat rollers 11A to 11K), to which the continuous sheet 110 contacts again in a second path of the conveyance of the continuous sheet 110 after passing the heat drum 12, define a second heating unit 10B. In the second heating unit 10B, the drying target object (i.e., the continuous sheet 110) that has been dried to the first dry state is heated to dry to a second dry state that is a state in which the continuous sheet 110 is further dried after the first dry state. Then, when the continuous sheet 110 is heated by the second heating unit 10B, the continuous sheet 110 that functions as a drying target object is guided by the multiple guide rollers 13 while the multiple guide rollers 13 are contacting the liquid applied face of the continuous sheet 110 that is as a drying target object.

Moreover, in the present embodiment, as described above, the first heating unit 10A and the second heating unit 10B share the multiple heat rollers 11 and cause the continuous sheet 110 that functions as a drying target object to contact the multiple heat rollers 11 from different angles and heat the drying target object.

Here, when the dry state of the liquid is not sufficient, an undried liquid on the drying target object adheres to rollers to be peeled from the drying target object (i.e., picking phenomenon), the liquid adhered to the rollers is transferred back onto the drying target object (i.e., hot offset phenomenon), and the liquid is offset or fixed between overlapped sheet faces when the sheet faces of, for example, a roll sheet are overlapped (i.e., blocking phenomenon).

In addition, since the temperature inside the drying device 104 increases, even the temperatures of the guide rollers in addition to the temperatures of the heat rollers also increase. Therefore, it is likely that liquid not yet dried sufficiently is thickened due to heat of the guide rollers to come off from the drying target object (i.e., the continuous sheet 110).

In order to address this inconvenience, it is preferable to dry the continuous sheet 110 to a dried state in which the liquid does not come off from the continuous sheet 110 due to picking or reheating by the guide rollers while the continuous sheet 110 is conveyed from the heat rollers 11 via the heat drum 12. However, if the conveying speed of the drying target object is reduced, the drying time takes longer.

For example, as a guide roller in a comparative drying device contacts a liquid applied face of a drying target object, if the liquid applied face of the drying target object is not dried sufficiently, liquid on the liquid applied face comes off during a drying process, that is, picking. In addition, since the temperature of the guide roller is increased, the liquid on the liquid applied face of the drying target object is heated again, and the viscosity of the liquid is reduced. As a result, the liquid comes off from the drying target object easily.

In this case, in the comparative drying device, the conveying speed of the drying target object is set to be slower, so that the guide rollers contact the drying target object after the drying target object has been dried enough to avoid occurrence of the picking. With this configuration of the comparative drying device, however, it takes longer to dry the drying target object.

Therefore, in the present embodiment, the guide roller 13A, which contacts the liquid applied face of the continuous sheet 110 during the drying process and guides the continuous sheet 110 from the heat drum 12 to the heat rollers 11, has a surface (i.e., a circumferential surface) having the surface roughness Ra of from 2 to 8, and the guide rollers 13B to 13K, by which the continuous sheet 110 is pressed against the heat rollers 11 also have respective surfaces (i.e., respective circumferential surfaces) each having the surface roughness Ra of from 2 to 8.

The roller having a surface roughness Ra of from 2 to 8 may include, for example, one of a ceramic spray roller and a metal spray roller.

Here, the surface roughness Ra is obtained by cutting by a reference length from the roughness curve in the direction of the average line of the roughness curve, taking an X axis in the direction of the average line of the cut length (distance) of the roughness curve and a Y axis in the direction of the longitudinal magnification. When the roughness curve is expressed by y=f (x), the value obtained by the following equation, Equation 1, is expressed by a micrometer (μm).

Equation 1.

$$Ra = \frac{1}{l}\int_0^l (f(x))dx. \qquad \text{Equation 1}$$

By setting the surface roughness Ra of the guide roller 13 from 2 to 8, as described above, when the guide roller 13 is brought into contact with the liquid applied face of the continuous sheet 110 that is heated by the heat rollers 11 and the heat drum 12, even if the liquid of the continuous sheet 110 is not sufficiently dried, the liquid does not peel off from the continuous sheet 110 to be transferred onto the guide roller 13. Therefore, the continuous sheet 110 is dried without causing any defect in the image.

The surface roughness of each of the guide rollers 13 is evaluated and determined as follows.

The liquid used in the present embodiment for printing for evaluation is an ink having the following characteristics.

Viscosity: Within a range of from 5.0 mPa·s to 12.0 mPa·s under the conditions of Temperature: 24±2° C., more preferablly, within a range of from 8.0 mPa·s to 9.0 mP·s.

Surface Tension (Static Surface Tension): 30 mN/m or less under the conditions of Temperature: 24±2° C., more preferably, within a range of from 20 mN/m to 26 mN/m.

Water Evaporation (30%): The viscosity is 100 mPa·s or less at 30 wt % of water evaporation, more preferably, 40 mPa·s or less.

Water Evaporation (40%): The viscosity is 300 mPa·s or less at 40 wt % of water evaporation, more preferably, 120 mPa·s or less.

Simple Deposition Evaluation: Accumulated deposition height less than 15 mm (millimeters) under the conditions of Drying Conditions: 32° C. and 30% RH (relative humidity), Dropping Speed: one drop/30 min., and Dropping Time: 48 hours from printing, and more preferably, less than 5.5 mm of accumulated deposition height.

Hardness: 0.07 or greater under the conditions of Temperature: 23±2° C., Humidity: 50% RH to 60% RH, Depth of Press: 200 nm at a speed of 40 nm/s, and after 20 hours (or greater) from printing (application), more preferably, 0.21±0.12.

Elastic Modulus: 1.1 or greater under the conditions of Temperature: 23±2° C., Humidity: 50% RH to 60% RH, Depth of Press: 200 nm at a speed of 40 nm/s, and after 20 hours (or greater) from printing (application), more preferably, 5.8±2.4.

Temperature of Heat Rollers 11: 150° C., Temperature of Heat Drum 12: 120° C., Temperature of airblow of the warm air blowing fans 16; 150° C. Here, when the drying device 104 is operated at 75 m/min. of the conveying speed of the continuous sheet 110, the guide rollers 13 receive the temperature in the drying device 104 and the heat from the continuous sheet 110. Consequently, the temperature rises, and therefore the temperature of the guide rollers 13 increases to around 140° C.

Under the above-described conditions, the guide rollers 13 having different surface roughness Ra were incorporated in the drying device 104, and the above-described ink was used to actually print on the continuous sheet 110, and the continuous sheet 110 is dried. Under this condition, the peeling of the liquid on the printed face (void ratio) was evaluated.

Figures 3, 4:
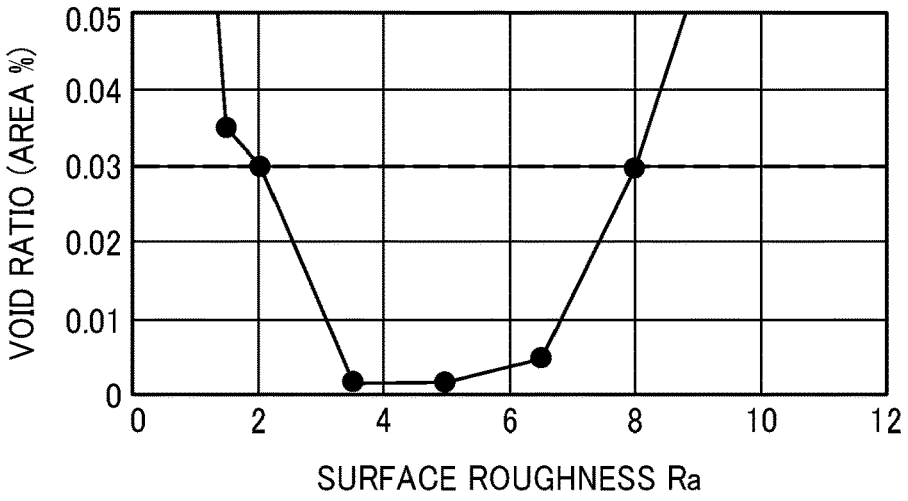
FIG. 3 is a table indicating evaluation results of surface roughnesses Ra and void ratios of guide rollers.
FIG. 4 is a graph illustrating the evaluation results of the table in FIG. 3.

The results are illustrated in FIGS. 3 and 4. It is to be noted that FIG. 3 is a table indicating evaluation results of the surface roughness Ra and the void ratio of each guide roller and FIG. 4 is a graph illustrating the evaluation results of the table in FIG. 3.

Here, the void ratio is a rate of white pixels (area ratio: %) on a solid image having the maximum amount of liquid adhesion, and is obtained by printing the solid image on a printed matter, drying the solid image on the printed matter, reading a given area of the solid image by a scanner at a resolution of 600 dpi, and binarizing the given area with a predetermined threshold.

If the void ratio is 0.03% or less, peeling of the liquid is not confirmed visually, and the image is evaluated as an image with no defect.

From FIGS. 3 and 4, when the surface roughness Ra of the guide roller 13 is less than 2 and is greater than 8, liquid peeling, which is one of various image defects, is confirmed (recognized). By contrast, when the surface roughness Ra of the guide roller 13 is from 2 to 8, the image is evaluated as an image with no liquid peeling or no image defect.

According to the above-described results, the guide roller 13 having the surface roughness Ra smaller than 2 has a smooth surface, and the guide roller 13 closely contacts the liquid on the continuous sheet 110, in other words, the guide roller 13 has surface contact with the liquid on the continuous sheet 110. Therefore, it is likely that the liquid adheres to the guide roller 13 easily, and liquid peeling occurs easily.

Further, when the guide roller 13 having the surface roughness Ra exceeding 8 is employed, even if the surface of the guide roller 13 is uneven, convex (projecting) portions of the surface of the guide roller 13 contacts the liquid on the continuous sheet 110 with a relatively large area. Therefore, it is likely that the liquid adheres easily, and liquid peeling occurs easily.

By contrast, with the guide rollers 13 having the surface roughness Ra of from 2 to 8, each of the guide rollers 13 contacts the liquid on the continuous sheet 110 at point contact to small points. Therefore, adhesion of the guide rollers 13 to the liquid is relatively small, and occurrence of peeling of the liquid is considered to be reduced.

In this case, from the results of FIGS. 3 and 4, the surface roughness Ra of the guide roller 13 is preferably from 3 to 7. It is more preferable to be from 3 to 5.

As described above, by using the guide roller having the surface roughness Ra of from 2 to 8, peeling of the liquid due to picking, in which the liquid on the continuous sheet during the drying process is adhered to the guide roller, or reheating is restrained. Therefore, the conveying speed of a drying target object is increased, and the drying time is reduced.

In this case, it is preferable to use the guide roller 13 coated with fluorine on the circumferential surface. Accordingly, transfer of liquid on the continuous sheet 110 during the drying process is restrained.

Figure 5:
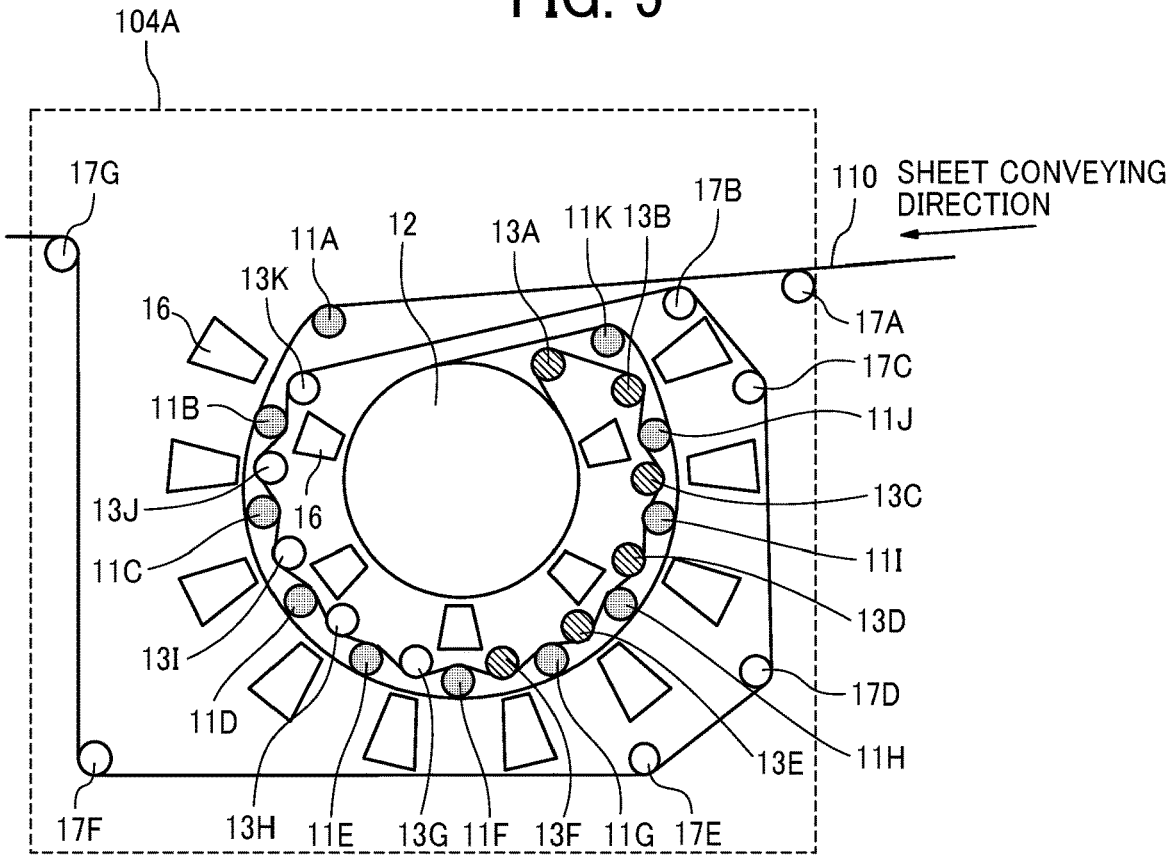
FIG. 5 is a diagram illustrating a drying device according to Embodiment 2 of this this disclosure.

Next, a description is given of a configuration according to Embodiment 2 of this disclosure, with reference to FIG. 5.

FIG. 5 is a diagram illustrating a drying device 104A according to Embodiment 2 of this disclosure.

In the present embodiment, among the guide rollers 13A to 13K that press the continuous sheet 110 against the heat rollers 11, two or more guide rollers 13 (in Embodiment 2, the guide rollers 13A to 13F) disposed on an upstream side of the sheet conveyance passage have the surface roughness Ra of from 2 to 8. By contrast, the guide rollers 13G to 13K have the surface roughness Ra of 1 or less.

Here, the guide rollers 13A to 13F include ceramic spray rollers and the guide rollers 13G to 13K include aluminum rollers.

That is, the guide rollers 13, which contact the liquid applied face of the continuous sheet 110 that is not sufficiently dried after the continuous sheet 110 has just passed the heat drum 12, have the surface roughness Ra of from 2 to 8. As a result, similar to Embodiment 1, peeling of the liquid due to picking or reheating is restrained, and therefore occurrence of defect images is also restrained.

Then, since the continuous sheet 110 is heated by the heat rollers 11 disposed between the guide rollers 13A to 13G, the continuous sheet 110 is further dried. Therefore, in a case in which any guide roller 13 having the surface roughness Ra of 2 or less is used, peeling or the liquid and other defects do not occur. Accordingly, when the guide rollers 13 disposed on the downstream side of the sheet conveying direction contact the liquid applied face of the continuous sheet 110 that has been further dried, the guide rollers 13 have the regular surface roughness Ra of 1 or less.

Since a spray roller is to be processed before use, the cost increases when compared with an aluminum roller. However, by disposing the adequate number of rollers as in Embodiment 2, the cost of the drying device 104A is reduced without degrading the drying quality.

It is to be noted that the above-described number of guide rollers 13 having the surface roughness Ra of from 2 to 8 is an example number. It is preferable to set the number of guide rollers 13 depending on the drying conditions such as the drying property of the liquid and the temperature setting of heating units such as the heat rollers, the heat drum, and the warm air blowing fans.

Figure 6:
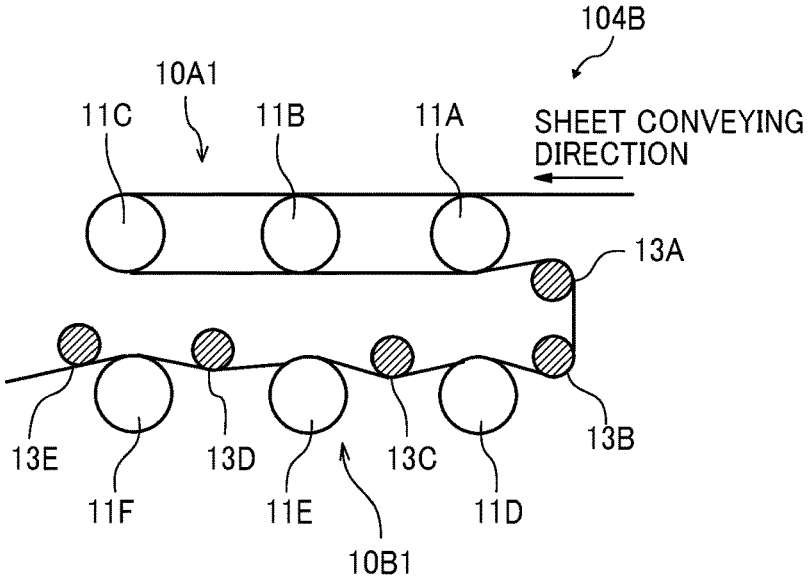
FIG. 6 is a diagram illustrating a drying device according to Embodiment 3 of this this disclosure.

Next, a description is given of a configuration according to Embodiment 3 of this disclosure, with reference to FIG. 6.

FIG. 6 is a schematic plan view of a drying device 104B according to Embodiment 3.

In the present embodiment, the drying device 104B includes a first heating unit 10A1 that is defined by the multiple heat rollers 11A to 11C to dry the continuous sheet 110 to the first dry state. The drying device 104B further includes a second heating unit 10B1 that is defined by the multiple heat rollers 11D to 11F to dry the continuous sheet 110 to the second dry state in which the drying process proceeds after the first dry state.

The drying device 104B includes the guide rollers 13A and 13B that guide the continuous sheet 110 after the continuous sheet 110 has passed the first heating unit 10A, to the second heating unit 10B. The drying device 104B further includes the guide rollers 13C to 13E that guide the continuous sheet 110 while pressing the continuous sheet 110 against the heat rollers 11D to 11F of the second heating unit 10B.

The guide rollers 13A to 13E contact the liquid applied face of the continuous sheet 110 during the drying process, to guide the continuous sheet 110.

Each of the guide rollers 13 to contact the liquid applied face of the continuous sheet 110 has a surface roughness Ra of from 2 to 8. As a result, peeling of the liquid due to picking or reheating is restrained, and therefore the drying speed of the liquid on the continuous sheet 110 is decreased.

In each of the above-described embodiments, the example in which the drying target object to be conveyed is a continuous sheet has been described. However, embodiments of this disclosure are not limited to the continuous sheet as long as the object is dried by the drying device according to this disclosure. Examples of a drying target object include a continuous body such as a continuous sheet, roll sheet, or a web-shaped sheet, a recording medium (print target object) such as a long sheet material, wall paper, and a printing material such as an electronic circuit board sheet such as a prepreg.

In addition to recording an image such as a letter or a figure with a liquid such as an ink, an image having no meaning, such as a pattern, may be applied to a drying target object to be conveyed in a printer, with a liquid such as an ink for the purpose of decoration.

In this disclosure, the liquid to be applied to a drying target object is not particularly limited. However, preferably, the viscosity of the liquid is not greater than 30 mPa·s under ordinary temperature and ordinary pressure or by heating or cooling. More specifically, examples of the liquid include a solution, a suspension, or an emulsion that contains, for example, a solvent such as water or an organic solvent, a colorant such as dye or pigment, a functional material such as a polymerizable compound, a resin, or a surfactant, a biocompatible material such as DNA, amino acid, protein, and calcium, or an edible material such as a natural colorant. Such a solution, a suspension, or an emulsion can be used for, e.g., inkjet ink, surface treatment solution, liquid for forming components of electronic element or light-emitting element or a resist pattern of electronic circuit, or a material solution for three-dimensional fabrication.

In a case in which the liquid discharging head is used as a liquid applying unit, examples of an energy source for generating energy to discharge liquid include a piezoelectric actuator (a laminated piezoelectric element or a thin-film piezoelectric element), a thermal actuator that employs a thermoelectric conversion element such as a heating resistor, and an electrostatic actuator including a diaphragm and opposed electrodes.

It is to be noted that image formation, recording, letter printing, and photograph printing are all synonymous in the printing in this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

What is claimed is:

1. A drying device comprising:

a plurality of guide rollers configured to contact a first face of a drying target object that is conveyed with liquid applied to the first face, while the drying target object is dried, the plurality of guide rollers including at least one guide roller having a surface roughness of from 2 to 8; and a heater configured to heat the drying target object while the plurality of guide rollers guides the drying target object, wherein the heater includes at least one heating roller configured to contact a second face of the drying target object opposing the first face while the drying target object is dried, wherein the heater is configured to transport the drying target object in a first conveyance direction, and to heat the drying target object to a first dry state with a first side of the at least one heating roller in contact with the drying target object, wherein the heater is configured to transport the drying target object in a second conveyance direction opposite the first conveyance direction, and to heat the drying target object from the first dry state to a second dry state with a second side of the at least one heating roller opposing the first side in contact with the drying target object, wherein the plurality of guide rollers are configured to guide the first face of the drying target object when the heater transports the drying target object in the second conveyance direction.

2. The drying device according to claim 1, wherein the at least one guide roller having the surface roughness of from 2 to 8 is disposed on an upstream side among the plurality of guide rollers in the second conveying direction.

3. The drying device according to claim 1, wherein the at least one guide roller having the surface roughness of from 2 to 8 includes a spray coated roller.

4. The drying device according to claim 3,
wherein the spray coated roller is one of a ceramic spray coated roller and a metal spray coated roller.

5. The drying device according to claim 1,
wherein the plurality of guide rollers has a circumferential surface coated with fluorine.

6. A printer comprising:
a liquid application device configured to apply liquid to the drying target object; and
the drying device according to claim 1.

7. The printer according to claim 6,
wherein the liquid has a viscosity in a range of from 5.0 mPa·s to 12.0 mPa·s under a condition of a temperature of 24±2° C.

8. The printer according to claim 6,
wherein the liquid has a static surface tension of 30 mN/m or less under a condition of a temperature of 24±2° C.

9. The printer according to claim 6,
wherein the liquid has a viscosity of 100 mPa·s or less at 30 wt % of water evaporation.

10. The printer according to claim 6,
wherein the liquid has a viscosity of 300 mPa·s or less at 40 wt % of water evaporation.

11. The printer according to claim 6,
wherein the liquid has an accumulated deposition height of less than 15 mm under conditions of a drying condition of 32° C. and 30% RH, a dropping speed of one drop per 30 min, and a dropping time of 48 hours.

12. The printer according to claim 6,
wherein the liquid has a hardness of 0.07 or greater under conditions of a temperature of 23±2° C., a humidity of from 50% RH to 60% RH, a depth of press of 200 nm at a speed of 40 nm/s, and after 20 hours or greater from application.

13. The printer according to claim 6,
wherein the liquid applied by the liquid application device has an elastic modulus of 1.1 or greater under conditions of a temperature of 23±2° C., a humidity of from 50% RH to 60% RH, a depth of press of 200 nm at a speed of 40 nm/s, and after 20 hours or greater from application.

14. The drying device according to claim 2,
wherein the at least one guide roller having the surface roughness of 1 or less is disposed on a downstream side among the plurality of guide rollers in the second conveying direction.

15. The printer according to claim 6,
wherein the liquid application device is configured to apply the liquid to form an image to the drying target object.

* * * * *